US007471052B2

(12) United States Patent
Wu et al.

(10) Patent No.: US 7,471,052 B2
(45) Date of Patent: Dec. 30, 2008

(54) CRYOGENIC VACUUMM RF FEEDTHROUGH DEVICE

(75) Inventors: Genfa Wu, Yorktown, VA (US); Harry Lawrence Phillips, Hayes, VA (US)

(73) Assignee: Jefferson Science Associates, Newport News, VA (US)

( * ) Notice: Subject to any disclaimer, the term of this patent is extended or adjusted under 35 U.S.C. 154(b) by 651 days.

(21) Appl. No.: 11/209,284

(22) Filed: Aug. 23, 2005

(65) Prior Publication Data

US 2007/0249399 A1 Oct. 25, 2007

(51) Int. Cl.
*H01J 23/00* (2006.01)

(52) U.S. Cl. ..... 315/500; 324/690; 250/309

(58) Field of Classification Search ..... 315/5.41, 315/111.61, 111.81, 500, 505; 324/71.3, 324/84, 438, 690, 751; 250/306, 309, 396 R
See application file for complete search history.

(56) References Cited

U.S. PATENT DOCUMENTS 3,580,057 A * 5/1971 Seegmiller ..... 73/597
4,527,091 A * 7/1985 Preist ..... 315/5
4,629,975 A * 12/1986 Fiorito et al. ..... 324/71.3
5,451,794 A * 9/1995 McKeown et al. ..... 250/492.3
6,018,861 A * 2/2000 Sheplak et al. ..... 29/595
6,812,647 B2 * 11/2004 Cornelius ..... 315/111.41
6,855,621 B2 * 2/2005 Kondo et al. ..... 438/513
2002/0005725 A1 * 1/2002 Scott ..... 324/637
2004/0195972 A1 * 10/2004 Cornelius ..... 315/111.21

* cited by examiner

*Primary Examiner*—David Hung Vu
*Assistant Examiner*—Tung X Le

(57) ABSTRACT

A cryogenic vacuum rf feedthrough device comprising: 1) a probe for insertion into a particle beam; 2) a coaxial cable comprising an inner conductor and an outer conductor, a dielectric/insulating layer surrounding the inner conductor, the latter being connected to the probe for the transmission of higher mode rf energy from the probe; and 3) a high thermal conductivity stub attached to the coaxial dielectric about and in thermal contact with the inner conductor which high thermal conductivity stub transmits heat generated in the vicinity of the probe efficiently and radially from the area of the probe and inner conductor all while maintaining useful rf transmission line characteristics between the inner and outer coaxial conductors.

12 Claims, 1 Drawing Sheet

CRYOGENIC VACUUMM RF FEEDTHROUGH DEVICE

The United States of America may have certain rights to this invention under Management and Operating contract No. DE-AC05-84ER 40150 from the Department of Energy

FIELD OF THE INVENTION

The present invention relates to cryogenic vacuum rf feedthrough devices and more particularly to such a device that provides optimized thermal conductivity and concomitant heat extraction.

BACKGROUND OF THE INVENTION

Particle accelerators utilize a fundamental rf power and frequency to accelerate the particle beam. As the accelerator operates, the beam stimulates the production of rf energy at different frequencies than those used to power the device (referred to as higher order modes). The generation of such higher order modes can interfere with the operation of the accelerator and also generate heat within the accelerator resulting in "missteering" of the beam. It is therefore desirable and necessary that such higher order rf frequencies and the heat generated thereby be extracted from the accelerator. The thermal conductance for obtaining the necessary heat extraction has been calculated and determined to be greater than 20 mW with less than 0.2 T at >5° K. Whatever mechanism is used to extract this heat, useful rf transmission line characteristics on the order of 50 ohms (to assure higher mode rf frequency extraction), vacuum hermeticity and mechanical integrity under cryogenic conditions must be maintained.

While rf feedthrough devices are known in the art, (such devices are commercially available from Amphenol, 358 Hall Ave., Wallingford, Conn. 06492) none to our knowledge, are capable of providing the high thermal conductance necessary to meet the thermal extraction needs just described.

It would therefore be highly desirable to provide a cryogenic vacuum rf feedthrough device that was capable of meeting these requirements in order to better stabilize the operation of particle accelerators.

OBJECT OF THE INVENTION

It is therefore an object of the present invention to provide a cryogenic vacuum rf feedthrough device that exhibits a high thermal conductance while maintaining useful rf transmission line characteristics.

SUMMARY OF THE INVENTION

According to the present invention, there is provided a cryogenic vacuum rf feedthrough device comprising: 1) a probe for insertion into a particle beam; 2) a coaxial cable comprising an inner conductor and an outer conductor and a dielectric/insulating layer surrounding the inner conductor, the latter being connected to the probe for the transmission of higher mode rf energy from the probe; and 3) a high thermal conductivity stub attached to the coaxial dielectric about and in thermal contact with the inner conductor which high thermal conductivity stub transmits heat generated in the vicinity of the probe efficiently and radially from the area of the probe and inner conductor all while maintaining useful rf transmission line characteristics between the inner and outer coaxial conductors. According to a highly preferred embodiment, the stub comprises a single crystal sapphire.

DETAILED DESCRIPTION

Figure 2:
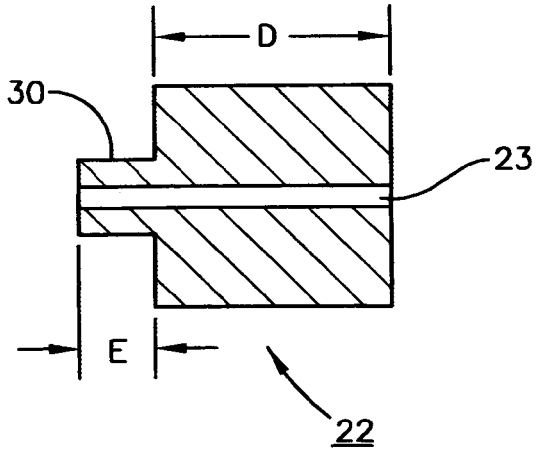
FIG. 2 is a cross-sectional view of the stub portion of the device of the present invention.

Referring now to the accompanying drawings, the cryogenic rf feedthrough device 10 of the present invention comprises a probe 12 for insertion into a particle beam traveling in the vacuum of the accelerator 26; a coaxial cable 14 comprising an inner conductor 16 and an outer conductor 18, a coaxial dielectric/insulating layer 20 surrounding the inner conductor 16, is connected to probe 12 for the transmission of higher mode rf energy from probe 12 to inner conductor 16; and 3) a high thermal conductivity stub 22 attached to the coaxial dielectric layer 20 about and in thermal contact with inner conductor 16 which high thermal conductivity stub 22 transmits heat generated in the vicinity of probe 12 efficiently and radially from the area of probe 12 and inner conductor 16 all while maintaining useful rf transmission line characteristics between the inner and outer coaxial conductors 14 and 16 respectively. As best seen in FIG. 2, stub 22 includes an aperture 23 for admission and retention of inner conductor 16. A heat sink 33 can be provided for the efficient extraction of heat from stub 22.

In operation, heat is generated in the particle beam in the area of probe 12, i.e. within volume 26, by the higher mode rf energy generated by the particle beam during operation. Cryogenic feedthrough device 10 of the present invention cools probe 12 by conduction through feedthrough device 10 and particularly the action of stub 22 described herein. Cryogenic feedthrough device 10 effectively dampens the effects of heat generated in vacuum chamber 26 within the particle accelerator by conducting the unwanted higher mode rf and thermal energy generated therein for dissipation via stub 22. The higher mode rf energy is conducted out of the system by inner conductor 12 while excess heat is dissipated radially through stub 22 and wall 32. In effect, probe 12 serves as an antenna attracting higher mode rf energy for transmission via inner conductor 16, as just described, while heat generated by such higher mode rf energy is removed through the conductive action of stub 22.

Figure 1:
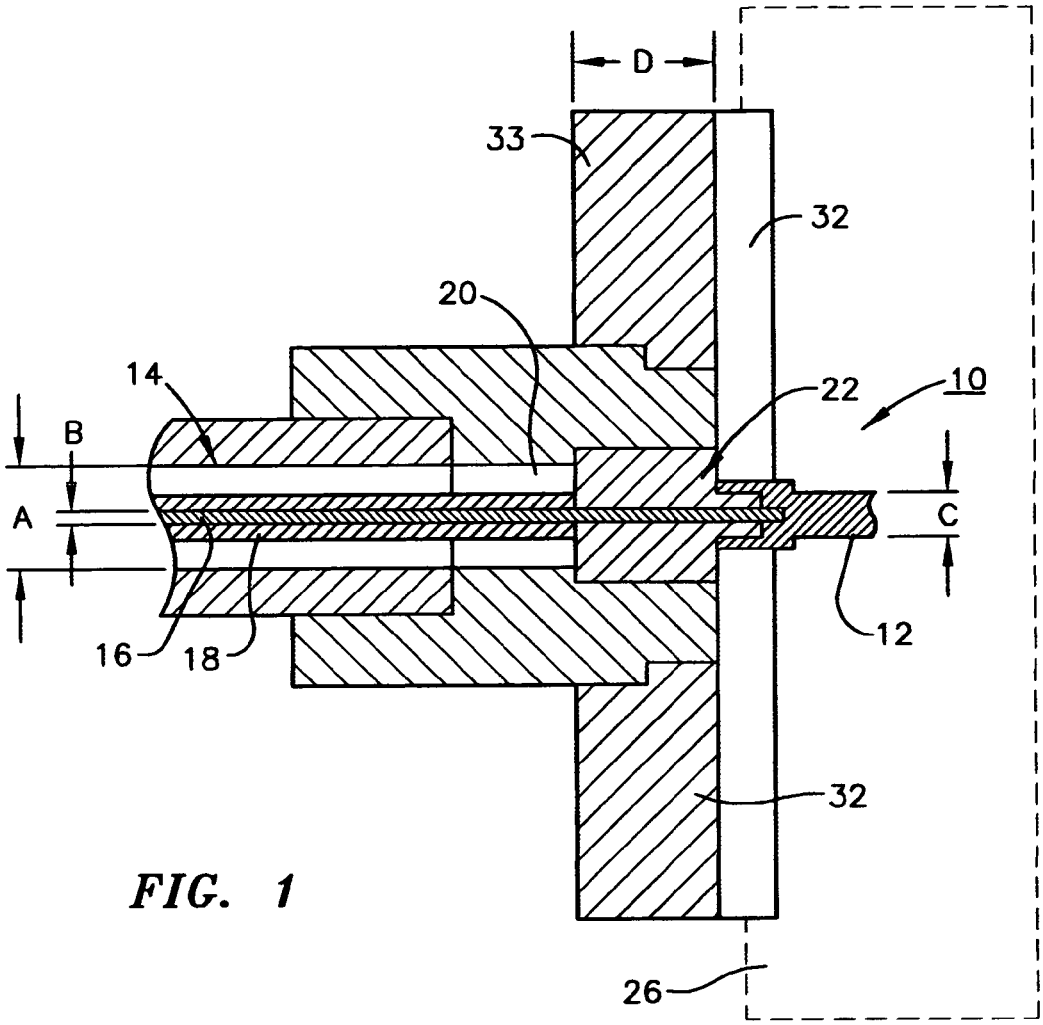
FIG. 1 is a cross-sectional view of the cryogenic vacuum feedthrough device of the present invention.

As will be apparent to the skilled artisan, the geometry of the various elements of device 10 is important if device 10 is to transmit rf energy over an acceptable bandwidth. Similarly, attachment of the various elements of cryogenic feedthrough device 10 are also important. While not wishing to be bound by any of the preferred dimensional elements described hereinafter, a useful device can be fabricated using the following dimensions whose alpha references refer to the same alpha designator in the accompanying FIG. 1. Coaxial cable 14 has an outer dimension A-A of about 0.1190 inches, inner conductor 16 is about 0.040 inches in diameter dimension B-B, probe 16 is about 0.120 inches in diameter dimension C-C, stub 22 is about 0.25 inches deep dimension D-D and includes an annular flange portion 30 that extends into probe 26 that is about 0.10 inches deep, dimension E-E.

Similarly, the materials of fabrication are also important to the successful practice of the present invention. Thus, probe 16 preferably comprises niobium. Perhaps the most important element of the cryogenic rf feedthrough device 10 of the present invention is stub 22. In order to meet the objectives of the present invention high heat extraction with stable rf transmission characteristics), stub 22 must exhibit a high thermal conductivity. While a particularly preferred material for the fabrication of stub 22 is single crystal sapphire, other high thermal conductivity materials are similarly useful. These include, for example aluminum and silicon nitride and polycrystalline sapphire. Since sapphire exhibits the following thermal conductivity it is highly preferred as the material of fabrication for stub 22.

Thermal conductivity of sapphire

| T (° K.) | W/cm. ° K. |
|---|---|
| 2 | 0.3 |
| 5 | 4 |
| 10 | 60 |

Thus, because of its high thermal conductivity, sapphire, particularly single crystal sapphire applied with its C axis parallel to coaxial cable 14 is especially preferred, while materials having high thermal conductivities approaching or greater than these levels can also be used in the fabrication of stub 22. Fabricated single crystal sapphires useful in the successful practice of the present invention are commercially available from Insaco, Inc., 1365 Canary Road, Quakertown, Pa. 18951.

Attachment of probe 12 to flange 30 of stub 22 is also important to assure a good hermetic seal and maintenance of mechanical integrity under cryogenic conditions. According to a preferred embodiment of the present invention such a joint is formed by brazing niobium probe 12 to flange 30 using a gold/copper alloy, as is relatively conventional in the art, although other suitable brazed or otherwise formed joints may also be used providing they are capable of meeting the demanding environmental demands placed upon them in this application.

As the invention has been described, it will be apparent to those skilled in the art that the same may be varied in many ways without departing from the spirit and scope of the invention. Any and all such modifications are intended to be within the scope of the appended claims.

What is claimed is:

1. A cryogenic vacuum radio frequency (RF) feedthrough device comprising:

A) a probe for insertion through a wall of a vacuum container into a particle beam circulating therein;

B) a coaxial cable comprising an inner conductor and an outer conductor and a dielectric/insulating layer surrounding the inner conductor, the inner conductor connected to the probe for the transmission of RF energy from the probe; and C) a high thermal conductivity stub attached to the coaxial dielectric about and in thermal contact with the inner conductor which the high thermal conductivity stub transmits heat generated in the vicinity of the probe and conducted to the stub radially from the inner conductor wall while maintaining useful RF transmission line characteristics between the inner and outer coaxial conductors.

2. The cryogenic vacuum RF feedthrough device of claim 1 wherein the probe comprises niobium.

3. The cryogenic vacuum RF feedthrough device of claim 2 wherein the stub is fabricated from a material selected from the group consisting of single crystal sapphire, polycrystalline sapphire, aluminum nitride and silicon nitride.

4. The cryogenic vacuum RF feedthrough device of claim 3 wherein the stub comprises single crystal sapphire.

5. The cryogenic vacuum RF feedthrough device of claim 2 wherein the coaxial cable has an outer dimension of about 0.1190 inches, the inner conductor is about 0.040 inches in diameter the probe is about 0.120 inches in diameter, the stub is about 0.25 inches deep as it passes through the wall and includes an annular flange portion that extends into the probe that is about 0.10 inches deep.

6. The cryogenic vacuum RF feedthrough device of claim 1 wherein the stub is fabricated from a material selected from the group consisting of single crystal sapphire, polycrystalline sapphire, aluminum nitride and silicon nitride.

7. The cryogenic vacuum RF feedthrough device of claim 6 wherein the stub comprises single crystal sapphire.

8. The cryogenic vacuum feedthrough device of claim 7 wherein the coaxial cable has an outer dimension of about 0.1190 inches, the inner conductor is about 0.040 inches in diameter the probe is about 0.120 inches in diameter, the stub is about 0.25 inches deep as it passes through the wall and includes an annular flange portion that extends into the probe that is about 0.10 inches deep.

9. The cryogenic vacuum RF feedthrough device of claim 6 wherein the coaxial cable has an outer dimension of about 0.1190 inches, the inner conductor is about 0.040 inches in diameter the probe is about 0.120 inches in diameter, the stub is about 0.25 inches deep as it passes through the wall and includes an annular flange portion that extends into the probe that is about 0.10 inches deep.

10. The cryogenic vacuum RF feedthrough device of claim 1 wherein the coaxial cable has an outer dimension of about 0.1190 inches, the inner conductor is about 0.040 inches in diameter the probe is about 0.120 inches in diameter, the stub is about 0.25 inches deep as it passes through the wall and includes an annular flange portion that extends into the probe that is about 0.10 inches deep.

11. The cryogenic vacuum RF feedthrough device of claim 1 wherein the stub includes an annular flange that is attached to the probe by the incorporation of a brazing layer.

12. The cryogenic vacuum feedthrough device of claim 11 wherein the brazing layer comprises a gold/copper alloy.

* * * * *